US006910949B1

(12) United States Patent
Radman

(10) Patent No.: US 6,910,949 B1
(45) Date of Patent: Jun. 28, 2005

(54) SPHERICAL CAP-SHAPED POLISHING HEAD IN A CHEMICAL MECHANICAL POLISHING APPARATUS FOR SEMICONDUCTOR WAFERS

(75) Inventor: Allan M. Radman, Aptos, CA (US)

(73) Assignee: Lam Research Corporation, Fremont, CA (US)

( * ) Notice: Subject to any disclaimer, the term of this patent is extended or adjusted under 35 U.S.C. 154(b) by 108 days.

(21) Appl. No.: 09/843,323

(22) Filed: Apr. 25, 2001

(51) Int. Cl.[7] ..... B24B 1/00; B24B 47/02; B24B 41/06

(52) U.S. Cl. ..... 451/41; 451/287; 451/288; 451/398; 451/402

(58) Field of Search ..... 451/41, 285, 287, 451/288, 289, 290, 384, 385, 388, 390, 397, 398, 402

(56) References Cited

U.S. PATENT DOCUMENTS

| | | | | | |
|---|---|---|---|---|---|
| 3,920,233 | A | * | 11/1975 | Stuckert | 250/292 |
| 5,441,444 | A | | 8/1995 | Nakajima | |
| 5,571,044 | A | | 11/1996 | Bolandi et al. | |
| 5,651,724 | A | * | 7/1997 | Kimura et al. | 451/285 |
| 5,762,544 | A | | 6/1998 | Zuniga et al. | |
| 5,769,692 | A | * | 6/1998 | Pasch et al. | 451/285 |
| 5,769,696 | A | | 6/1998 | Lee et al. | 451/287 |
| 5,769,699 | A | | 6/1998 | Yu | 451/528 |
| 5,791,973 | A | * | 8/1998 | Nishio | 451/288 |
| 5,795,215 | A | * | 8/1998 | Guthrie et al. | 451/285 |
| 5,803,799 | A | | 9/1998 | Volodarsky et al. | 451/288 |
| 5,857,899 | A | | 1/1999 | Volodarsky et al. | 451/72 |
| 5,916,012 | A | | 6/1999 | Pant et al. | 451/41 |
| 5,931,725 | A | * | 8/1999 | Inaba et al. | 451/288 |
| 5,938,884 | A | * | 8/1999 | Hoshizaki et al. | 156/345.14 |
| 6,024,630 | A | * | 2/2000 | Shendon et al. | 451/285 |
| 6,068,544 | A | | 5/2000 | Chiu et al. | 451/67 |
| 6,080,049 | A | * | 6/2000 | Numoto et al. | 451/285 |
| 6,086,460 | A | | 7/2000 | Labunsky et al. | 451/56 |
| 6,090,475 | A | | 7/2000 | Robinson et al. | 428/212 |
| 6,113,466 | A | * | 9/2000 | Lin | 451/289 |
| 6,174,221 | B1 | * | 1/2001 | Gotcher, Jr. | 451/286 |
| 6,176,764 | B1 | * | 1/2001 | Gotcher | 451/287 |
| 6,283,834 | B1 | * | 9/2001 | Liauzu | 451/285 |
| 6,290,577 | B1 | * | 9/2001 | Shendon et al. | 451/285 |
| 6,315,649 | B1 | * | 11/2001 | Hu et al. | 451/28 |
| 6,416,402 | B1 | * | 7/2002 | Moore | 451/289 |
| 6,422,927 | B1 | * | 7/2002 | Zuniga | 451/285 |

* cited by examiner

*Primary Examiner*—M. Rachuba
(74) *Attorney, Agent, or Firm*—Brinks Hofer Gilson & Lione

(57) ABSTRACT

A polishing head for use in an apparatus for chemically-mechanically polishing semiconductor wafers is provided. The polishing head includes a first side having at least a portion thereof operably connectable with a spindle on the apparatus; and a second side opposite the first side, the second side having a substantially spherical cap shape comprising an outer region adapted to apply a first force onto a semiconductor wafer against a polishing pad, and an inner region adapted to apply a second force onto the semiconductor wafer against the polishing pad, the second force being different from the first force, whereby the first force and the second force cause the polishing pad to planarize the semiconductor wafer substantially uniformly. A method of polishing semiconductor wafers is also provided.

19 Claims, 1 Drawing Sheet

SPHERICAL CAP-SHAPED POLISHING HEAD IN A CHEMICAL MECHANICAL POLISHING APPARATUS FOR SEMICONDUCTOR WAFERS

FIELD OF THE INVENTION

The present invention relates to a substantially spherically cap-shaped polishing head for use in an apparatus for the chemical mechanical planarization of semiconductor wafers. A method of polishing a semiconductor wafer using a substantially spherically cap-shaped polishing head is also provided.

BACKGROUND

Semiconductor wafers are commonly constructed in layers, where a portion of a circuit is created on a first level and conductive vias are made to connect up to the next level of the circuit. After each layer of the circuit is etched on the semiconductor wafer, an oxide layer is laid down. The oxide layer allows the vias to pass through, but covers the rest of the previous circuit level. Each layer of the circuit can create or add non-uniformities to the semiconductor wafer that are preferably smoothed out before generating the next circuit layer.

Chemical mechanical planarization (CMP) is used to planarize the raw wafer and each layer of material added thereafter. Conventional CMP apparatuses often use a rotating wafer holder that brings the semiconductor wafer into contact with a polishing pad. The polishing pad moves in the plane of the semiconductor wafer surface to be polished. A polishing fluid, such as a chemical polishing agent or slurry containing microabrasives, is applied to the polishing pad. The wafer holder then presses the semiconductor wafer against the rotating polishing pad, and polishing commences.

Conventional CMP systems have difficulty achieving a uniform surface across a semiconductor wafer. With these systems, it has been observed that the removal rate of semiconductor surface is higher toward the center of the semiconductor wafer and lower toward the perimeter of the semiconductor wafer. This uneven removal rate creates undesirable non-uniformities in the surface of the semiconductor wafer.

A CMP apparatus and method are needed that produce a substantially uniform surface across a semiconductor wafer. Specifically, a CMP apparatus and method are needed that have substantially the same removal rate in the center region of the semiconductor wafer as in perimeter region of the semiconductor wafer.

SUMMARY

The apparatuses and methods of the present invention address at least some of the problems of the prior art.

In one aspect of the invention, a polishing head for use in an apparatus for chemically-mechanically polishing semiconductor wafers is provided. The polishing head comprises a first side having at least a portion thereof operably connectable with a spindle on the apparatus, and a second side opposite the first side, the second side having a substantially spherical cap shape comprising an outer region adapted to apply a first force onto a semiconductor wafer against a polishing pad, and an inner region adapted to apply a second force onto the semiconductor wafer against the polishing pad, the second force being different from the first force, whereby the first force and the second force cause the polishing pad to planarize the semiconductor wafer substantially uniformly.

In another aspect of the invention, a method of polishing a semiconductor wafer in a chemical mechanical polishing apparatus is provided. The method comprises: (a) providing a chemical mechanical polishing apparatus having a polishing head comprising a first side having at least a portion thereof in contact with a spindle on the apparatus, and a second side opposite the first side, the second side having a substantially spherical cap shape comprising an outer region and an inner region; (b) securing the semiconductor wafer in the polishing head, the semiconductor wafer having a center region and a perimeter region; (c) inserting a polishing pad in the apparatus; (d) applying a first force using the outer region of the spherical cap shape, the first force tending to press a perimeter region of the semiconductor wafer against a polishing pad; (e) applying a second force using the inner region of the spherical cap shape, the second force being different from the first force and tending to press a center region of the semiconductor wafer against the polishing pad; and (f) polishing the semiconductor wafer such that the first force and the second force cause the polishing pad to remove semiconductor surface at substantially the same rate in the center region and in the perimeter region of the semiconductor wafer.

In still another aspect of the invention, another polishing head in an apparatus for chemically-mechanically polishing semiconductor wafers is provided. The polishing head comprises a first side having at least a portion thereof operably connectable with a spindle on the apparatus; and a second side opposite the first side, the second side having a flat rim surrounding a substantially spherical cap shape that is concave relative to a semiconductor wafer, the spherical cap shape comprising an outer region that, in conjunction with the flat rim, is adapted to apply a first force onto a semiconductor wafer against a polishing pad, and an inner region adapted to apply a second force onto the semiconductor wafer against the polishing pad, the second force being different from the first force, whereby the first force and the second force cause the polishing pad to planarize the semiconductor wafer substantially uniformly.

The present invention provides the foregoing and other features, and the advantages of the invention will become further apparent from the following detailed description of the presently preferred embodiments, read in conjunction with the accompanying drawings. The detailed description and drawings are merely illustrative of the invention and do not limit the scope of the invention, which is defined by the appended claims and equivalents thereof.

DETAILED DESCRIPTION OF THE PRESENTLY PREFERRED EMBODIMENTS

Definitions

A semiconductor wafer having a substantially circular shape, for purposes of this application, is said to have a "perimeter region" and a "central region." The perimeter region is shaped roughly like a doughnut. The outer edge of the perimeter region is the outer perimeter of the semiconductor wafer. The inner edge of the perimeter region is a constant distance from the outer edge, but the distance is less than the distance from the perimeter region to the center point of the semiconductor wafer. In other words, like a perfect doughnut, the perimeter region is the same thickness at any given point. The "central region" of the circular semiconductor wafer includes the center point of the circle, and extends radially therefrom until it meets the perimeter region.

A "spherical cap" is the shape that is created when a sphere is sliced with a plane. A "substantially spherical cap" means that the shape that is cut by a given plane need not be precisely spherical, but it is substantially orb-like.

A spherical cap, for purposes of this application, is said to have an "inner region" and an "outer region." These regions can best be visualized by imagining a sphere such as a basketball that is sliced once with a first plane to create two spherical caps. In this example, assume the first plane divides the ball into a top half and a bottom half. Next, imagine slicing the top half of the basketball once again with a second plane that is parallel to the first plane. One portion of the top half of the basketball still looks like a spherical cap. This portion is the inner region of the spherical cap. The other portion of the top half is shaped like a spherical segment that surrounds the inner region. This other portion is the outer region of the spherical cap.

Drawings

Figure 1:
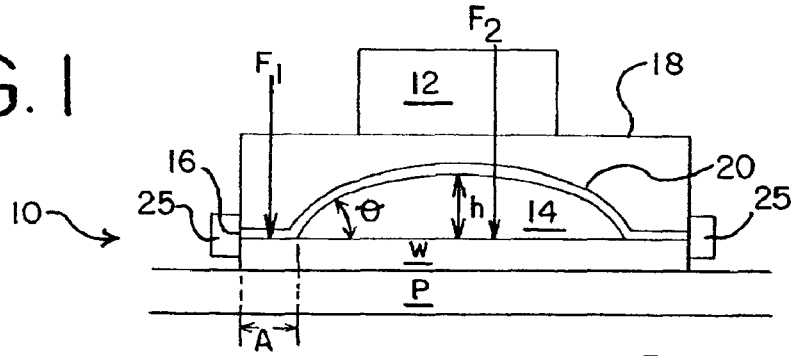
FIG. 1 shows an embodiment of a polishing head for use in a chemical mechanical planarization apparatus.

FIG. 1 shows a polishing head 10 for use in a CMP apparatus. The polishing head 10 can be mounted to any suitable CMP apparatus, including linear polishing systems such as the TERES CMP system, available from Lam Research Corporation of Fremont, Calif.; rotary polishing systems such as the MIRRA CMP system, available from Applied Materials of Santa Clara, Calif.; and other suitable CMP systems known to those who are skilled in the art. The polishing head can be used to polish semiconductor wafers as well as silicon-on-insulator (SOI) surfaces, silicon-on-sapphire (SOS) surfaces and other surfaces that are fabricated on non-conductive carriers.

The polishing head 10 is in contact with a spindle 12. Preferably, the spindle 12 attaches to a first side 18 of the polishing head 10. In one embodiment, the spindle 12 is rigidly attached to the side 18 by bolts, adhesives, friction fitting, or other attachment mechanisms known to those of skill in the art. In other embodiments, the polishing head 10 may be removably attached to the spindle 12 by any of a number of known tool-changing mechanisms.

A spindle drive assembly (not shown) controls the spindle 12 during polishing. The spindle drive assembly causes the spindle 12 and the polishing head 10 to rotate about an axis that is preferably in the center of the polishing head 10 and that is parallel to the longitudinal axis of the spindle 12. The spindle drive assembly also applies a predetermined force to the polishing head 10 during polishing, which in turn presses a semiconductor wafer W against a polishing pad P.

The polishing head 10 has a second side 16 that is opposite the first side 18. In FIG. 1, the second side 16 has a region A that surrounds a substantially spherical cap 14. The flat, annular region A is optional, meaning that the region A has a uniform thickness that can vary from 0 mm in some embodiments to about 10 mm in other embodiments. Preferably, the region A has a uniform thickness of about 7 mm or less. More preferably, region A has a uniform thickness of from about 3 mm to about 5 mm.

Figure 2:
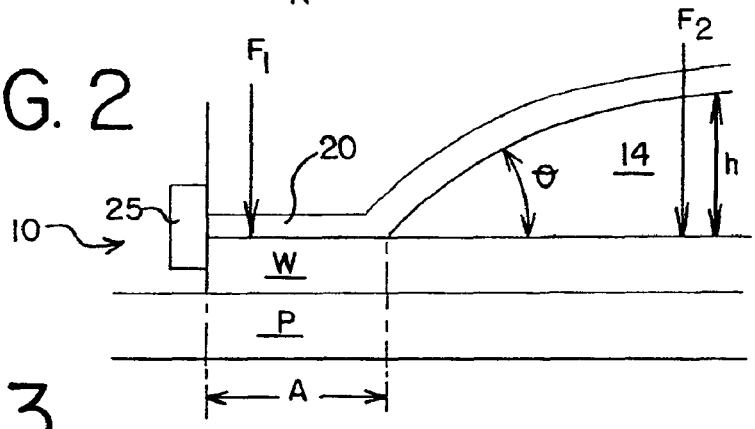
FIG. 2 shows a close-up view of a polishing head for use in the chemical mechanical planarization apparatus of FIG. 1.
Figure 3:
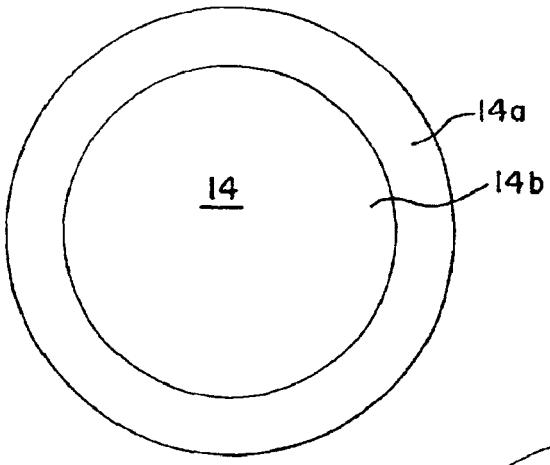
FIG. 3 shows a top view of a spherical cap for use in the polishing head of FIGS. 1 and 2.

In FIGS. 1 and 2, the substantially spherical cap 14 is concave relative to the semiconductor wafer W. The substantially spherical cap 14 can be either concave or convex. The substantially spherical cap 14 has an outer region and an inner region. Referring to FIG. 3, a top view of the substantially spherical cap shape is shown. The outermost area is outer region 14*a*, and the innermost area is inner region 14*b*.

In this case, the first plane that cuts the sphere to make the substantially spherical cap 14 is the surface of semiconductor wafer W that is to be polished. There is a second, imaginary plane that is parallel to the surface of semiconductor wafer W that divides the substantially spherical cap 14 into the outer region 14*a* and the inner region 14*b*.

Preferably, the height of the outer region 14*a* of the substantially spherical cap 14, which is the straight-line distance between the first plane and the second plane where the straight line is normal to both planes, is from about 0.1 mm to about 5 mm, more preferably from about 0.5 mm to about 3 mm. The inner region 14*b* of the substantially spherical cap 14 comprises the portion of the substantially spherical cap 14 that excludes the outer region 14*a*.

The substantially spherical cap 14 has a contact angle θ, which is the rye angle between (1) the normal to the sphere at the bottom of the substantially spherical cap 14, and (2) the base plane (in this case, the surface of the semiconductor wafer W to be polished). In other words, the contact angle θ is defined by a point of contact between the concave substantially spherical cap shape and the semiconductor wafer W. For convenience, the angle can be measured a certain distance away from the point of contact along the surface of the semiconductor wafer W. Preferably, this distance is short, such as 1 mm, 2 mm, or 5 mm.

The contact angle θ should be relatively small. Preferably, the substantially spherical cap 14 has a contact angle θ of about 10 degrees or less; more preferably, about 5 degrees or less; and most preferably, from about 0.5 degrees to about 2 degrees. For these measurements, the contact angle is measured at 1 mm from the point of contact along the surface of the semiconductor wafer W.

The substantially spherical cap 14 also has a height h. The height h is measured from the midpoint of the substantially spherical cap 14 to the surface of the semiconductor wafer W. Preferably, the height h is less than about 5 mm, more preferably less than about 2 mm, and most preferably about 1 mm.

Optionally, the substantially spherical cap 14 is lined with a carrier film 20. The purpose of carrier film 20 is to prevent the semiconductor wafer W from moving around during polishing. The carrier film 20 can be any standard film used in semiconductor manufacturing and processing that is suitable for contacting the semiconductor wafer W during polishing. Carrier films are typically made of polymeric material and commercially available from manufacturers of CMP auxiliary equipment, such as RODEL in Newark, Del. Preferably, the carrier film 20 is an oxide. The carrier film 20 may contain tungsten, copper, or aluminum.

The carrier film 20 is attached to the substantially spherical cap 14 by adhering the carrier film 20 to the surface of the substantially spherical cap 14 with an adhesive. Pressure sensitive adhesives are preferred. Once applied, the carrier film 20 can be laid to any desired thickness.

Such carrier films and the process for attaching the carrier films to polishing heads are described in U.S. Pat. No. 5,769,696, which is hereby incorporated by reference in its entirety.

The polishing head 10 can be adapted to secure the semiconductor wafer W. The polishing head 10 can secure the semiconductor wafer W using any mechanism known in the art. Some preferred securing mechanisms include the types shown in U.S. Pat. No. 5,803,799, which is hereby incorporated by reference in its entirety.

The polishing head 10 need not hold the semiconductor wafer W. In embodiments where the polishing head 10 does not have a securing mechanism for the semiconductor wafer W, the semiconductor wafer W is secured in the CMP system by a clamping system 25 or any other system that is well known in the art. In FIGS. 1 and 2, the clamping system 25 holds the wafer in place. Some preferred clamping systems are disclosed in U.S. Pat. No. 6,068,544, which is hereby incorporated by reference in its entirety, and the wafer carrier/wafer retainer arrangement disclosed in U.S. Pat. No. 5,857,899, which is hereby incorporated by reference in its entirety.

The polishing pad P can be any suitable polishing pad known to those who are skilled in the art. The polishing pad P can be of the type used with a slurry-based dispersed abrasive polishing system as exemplified in U.S. Pat. No. 5,916,012, which is hereby incorporated by reference in its entirety. Alternatively, the polishing pad P can incorporate a fixed abrasive as exemplified in U.S. Pat. No. 6,090,475, which is hereby incorporated by reference in its entirety.

The polishing pad P can be fixed during polishing. Alternatively, the polishing pad P can rotate about an axis during polishing, as in a MIRRA CMP system. Preferably, the polishing pad P moves linearly around a set of rollers during polishing, as it does in TERES CMP systems, shown in FIGS. 4–6 of U.S. Pat. No. 6,086,460 which is hereby incorporated by reference in its entirety.

Preferred polishing pads include the polishing pads of the type disclosed in U.S. Pat. No. 5,769,699, which is hereby incorporated by reference in its entirety.

Figure 4:
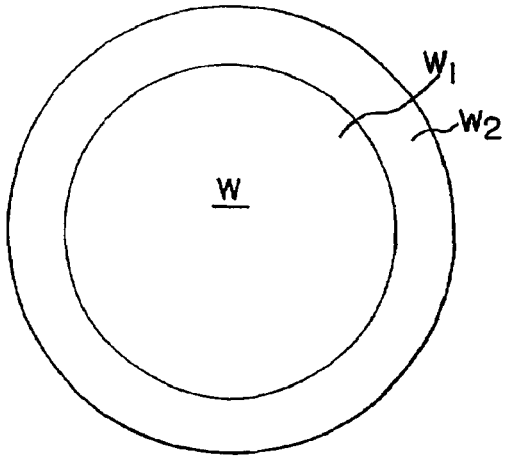
FIG. 4 shows a top view of a semiconductor wafer.

Referring to FIG. 4, the perimeter region W2 of a semiconductor wafer W is preferably shaped like a rim that has a uniform thickness of less than 10 mm, preferably less than 5 mm. The center region W1 of the semiconductor wafer includes the center point, and extends radially therefrom until it meets the perimeter region W2.

Using the Preferred Embodiments

Using conventional CMP systems, a user may observe that the removal rate of semiconductor surface is greater in the center region W1 than in the perimeter region W2 of the semiconductor wafer W. The difference in removal rates causes the semiconductor wafer W to have the non-uniformity of being thicker in the perimeter region W2 than in the center region W1.

To correct the non-uniformities, the polishing head 10 of FIG. 1 is shaped so that the perimeter region W2 of the semiconductor wafer W is pressed against the polishing pad P with greater force than is the center region W1. Referring to FIGS. 1 and 2, force F, is greater than force $F_2$.

The part of the polishing head 10 that contributes to applying force $F_1$ is the region A and the outer region 14*b* of the substantially spherical cap 14. The part of the polishing head 10 that contributes to applying force $F_2$ is the inner region 14*a* of the substantially spherical cap 14.

The extent to which $F_1$ is greater than force $F_2$ depends upon the contact angle θ and the height h of the substantially spherical cap 14. As the contact angle θ increases, the height h also increases. As the contact angle θ and the height h increase, the difference between force $F_1$ and force $F_2$ also increase.

So, if the observed non-uniformities are slight, force $F_1$ and force $F_2$ should be kept near each other in magnitude. This means that the polishing head 10 should be shaped so that the values for the contact angle θ and the height h are chosen from the lower end of the above-stated ranges for these variables. Slight non-uniformities in the surface of semiconductor wafer W include variations in thickness of less than about 1 mm.

In contrast, if the non-uniformities are severe, force $F_1$ and force $F_2$ should be noticeably different from each other in magnitude. This means that the polishing head 10 should be shaped so that the values for the contact angle θ and the height h are chosen from the higher end of the above-stated ranges for these variables. Severe non-uniformities in the surface of semiconductor wafer W include variations in thickness greater than about 2 mm.

Also, the polishing head 10 can be shaped to account for the positioning of the observed non-uniformities. If the non-uniformities tend to occur only in the outer 1 mm of the semiconductor wafer W, then the polishing head 10 should be made so that the region A is about 1 mm. If the non-uniformities occur in the outer 3 mm of the semiconductor wafer W, then the polishing head 10 should be made so that the region A is about 3 mm.

By shaping the polishing head 10 to address the observed non-uniformities, the removal rate of semiconductor wafer surface toward the center region W1 of semiconductor wafer W can be made to be substantially the same as the removal rate toward the perimeter region W2 of the semiconductor wafer W. By "substantially the same", it is meant that the removal rates are different by no more than 15%, preferably no more than 10%. Because the removal rates are substantially the same in both the center region W1 and the perimeter region W2 of the semiconductor wafer, the polished semiconductor wafer has a substantially uniform surface. By "substantially uniform surface" it is meant that the surface has no peaks or valleys greater than 5% of the thickness of the wafer, no greater than 2%.

It is intended that the foregoing detailed description be regarded as illustrative rather than limiting, and that it be understood that the following claims, including all equivalents, are intended to define the scope of this invention.

What is claimed is:

1. A polishing head in an apparatus for chemically-mechanically polishing semiconductor wafers, the polishing head comprising:

(a) a first side having at least a portion thereof operably connectable with a spindle on the apparatus, a downward force being applied exclusively by a mechanical force applied by the spindle to the semiconductor wafer during planarization; and (b) a second side opposite the first side, the second side having a substantially spherical cap shape comprising an outer region adapted to apply a first force onto a semiconductor wafer against a polishing pad, and an inner region adapted to apply a second force onto the semiconductor wafer against the polishing pad, the first force being greater than the second force, and wherein the first force and the second force cause the polishing pad to planarize the semiconductor wafer substantially uniformly;

wherein the shape of the spherical cap distributes the downward mechanical force applied by the spindle as the first and second forces applied by the outer and inner regions of the spherical cap.

2. The polishing head of claim 1 wherein the substantially spherical cap shape is concave relative to the semiconductor wafer.

3. The polishing head of claim 2 wherein an angle defined by a point of contact between the concave substantially spherical cap shape and the semiconductor wafer is less than 10 degrees.

4. The polishing head of claim 2 wherein an angle defined by a point of contact between the concave substantially spherical cap shape and the semiconductor wafer is less than 5 degrees.

5. The polishing head of claim 1 wherein the substantially spherical cap shape is convex relative to the semiconductor wafer.

6. The polishing head of claim 1 wherein the second side further comprises a flat rim around the outer perimeter of the substantially spherical cap shape.

7. The polishing head of claim 6 wherein the flat rim has a width of less than about 5 mm.

8. The polishing head of claim 1 wherein the apparatus for chemically-mechanically polishing semiconductor wafers is a TERES apparatus.

9. A method of polishing a semiconductor wafer in a chemical mechanical polishing apparatus, the method comprising:

(a) providing a chemical mechanical polishing apparatus having a polishing head comprising a first side having at least a portion thereof in contact with a spindle on the apparatus, and a second side opposite the first side, the second side having a substantially spherical cap shape comprising an outer region and an inner region;

(b) securing the semiconductor wafer in the polishing head, the semiconductor wafer having a center region and a perimeter region;

(c) inserting a polishing pad in the apparatus;

(d) applying a downward force, the downward force being applied exclusively through a mechanical force applied by the spindle to the semiconductor wafer, wherein the spherical cap shape distributes the downward mechanical force applied by the spindle as a first force applied by the outer region of the spherical cap shape and a second force applied by the inner region of the spherical cap shape, the first force tending to press a perimeter region of the semiconductor wafer against a polishing pad the second force tending to press a center region of the semiconductor wafer against the polishing pad, the first force being greater than the second force; and (e) polishing the semiconductor wafer such that the first force and the second force cause the polishing pad to remove semiconductor surface at substantially the same rate in the center region and in the perimeter region of the semiconductor wafer.

10. The method of claim 9 wherein steps (d) and (e) are performed simultaneously.

11. The method of claim 9 wherein during the polishing step (d), the polishing pad rotates about an axis substantially perpendicular to the semiconductor wafer.

12. The method of claim 9 wherein during the polishing step (d), the polishing pad remains stationary.

13. The method of claim 9 wherein during the polishing step (d), the semiconductor wafer is stationary.

14. The method of claim 9 wherein during the polishing step (d), the semiconductor wafer rotates about an axis in the center region of the semiconductor that is perpendicular to the surface of the semiconductor wafer.

15. The method of claim 9 wherein the second side also has a flat rim surrounding the substantially spherical cap shape.

16. The method of claim 15 wherein the first force is applied to the perimeter region of the semiconductor using both the flat rim surrounding the substantially spherical cap shape and the outer region of the substantially spherical cap shape.

17. The method of claim 9 wherein the substantially spherical cap shape is, concave relative to the semiconductor wafer.

18. A polishing head in an apparatus for chemically-mechanically polishing semiconductor wafers, the polishing head comprising:

(a) a first side having at least a portion thereof operably connectable with a spindle on the apparatus, a downward force being applied exclusively by a mechanical force applied by the spindle to the semiconductor wafer during planarization; and (b) a second side opposite the first side, the second side having a flat rim surrounding a substantially spherical cap shape that is concave relative to a semiconductor wafer, the spherical cap shape comprising an outer region that, in conjunction with the flat rim, is adapted to apply a first force onto a semiconductor wafer against a polishing pad, and an inner region adapted to apply a second force onto the semiconductor wafer against the polishing pad, the first force being greater than the second force, and wherein the first force and the second force cause the polishing pad to planarize the semiconductor wafer substantially uniformly;

wherein the the spherical cap shape distributes the downward mechanical force applied by the spindle as the first and second forces applied by the outer and inner regions of the spherical cap.

19. A polishing head for chemically-mechanically polishing semiconductor wafers, the polishing head comprising:

(a) a first side having at least a portion thereof operably connectable with a spindle on the apparatus, a downward force being applied exclusively by a mechanical force applied by the spindle to the semiconductor wafer during planarization; and (b) a second side opposite the first side, the second side having a substantially spherical cap having a concave shape relative to the semiconductor wafer to be polished comprising an outer region adapted to apply a first force and an inner region adapted to apply a second force, wherein the concave shape of the spherical cap distributes the downward mechanical force applied by the spindle as the first and second forces applied by the outer and inner region of the spherical cap.

* * * * *